US005609338A

United States Patent [19]

Ibrahim

[11] Patent Number: 5,609,338

[45] Date of Patent: Mar. 11, 1997

[54] PUZZLE WITH RECTANGULAR PIECES OF DIFFERENT LENGTHS

[76] Inventor: Aftab Ibrahim, 99 Blackwell Avenue, Apt. #604, Scarborough, Ontario, Canada, M1B 3R5

[21] Appl. No.: 563,276

[22] Filed: Nov. 28, 1995

[51] Int. Cl.[6] ..... A63F 9/08

[52] U.S. Cl. ..... 273/156; 273/153 S

[58] Field of Search ..... 273/153 R, 156, 273/157 R, 157 A, 153 S, 160

[56] References Cited

U.S. PATENT DOCUMENTS 1,017,752 2/1912 Hardy ..... 273/153 S 1,277,391 9/1918 Crouse ..... 273/153 S 1,415,625 5/1922 Bullster ..... 273/153 S 4,142,726 3/1979 Anderson ..... 273/157 R

*Primary Examiner*—William H. Grieb

[57] ABSTRACT

A puzzle has different groups of playing pieces which form a full rectangle only when they are properly fitted with one another. All of the playing pieces from all of the groups have a rectangular configuration and each playing piece of a particular group has the same shape and size and is interchangeable in position in the puzzle with all other pieces from that particular group. The puzzle also includes a number of individual rectangular playing pieces which must be fitted with the groups of playing pieces to complete the puzzle.

5 Claims, 2 Drawing Sheets

PUZZLE WITH RECTANGULAR PIECES OF DIFFERENT LENGTHS

FIELD OF THE INVENTION

The present invention relates to a puzzle formed of playing pieces which must be fitted together in the proper position to complete the puzzle.

BACKGROUND OF THE INVENTION

A conventional puzzle comprises a series of puzzle pieces which must fit with one another in one specific manner in order to complete the puzzle.

Typically, most of the playing pieces of the above type of puzzle have unique shapes and in most puzzles the pieces fit together to form a colored image or the like. Often times a person putting the puzzle together can ascertain where a particular piece fits in the puzzle simply by the shape and/or colored markings on that particular piece which indicate how it will fit with other pieces forming the background of the puzzle. This makes the conventional type of puzzle relatively simple to put together.

SUMMARY OF THE INVENTION

The present invention relates to a puzzle having different groups of playing pieces which form a full rectangle only when they are properly fitted with one another. All of the playing pieces from all of the groups have a rectangular configuration so that the position of each individual puzzle piece can not be ascertained simply by looking for a piece of a specific or unique shape.

To add to the interest in assembling the puzzle, each playing piece of a particular group has the same shape size and is interchangeable in position in the puzzle with other playing pieces from that particular group.

As a further feature to add to the difficulty in putting the puzzle together, it also includes a number of individual rectangular playing pieces which must be fitted with a specific combination of other playing pieces to complete the puzzle.

BRIEF DESCRIPTION OF THE DRAWINGS

The above as well as other advantages and features of the present invention will be described in greater detail according to the preferred embodiments of the present invention in which.

Figure 1:
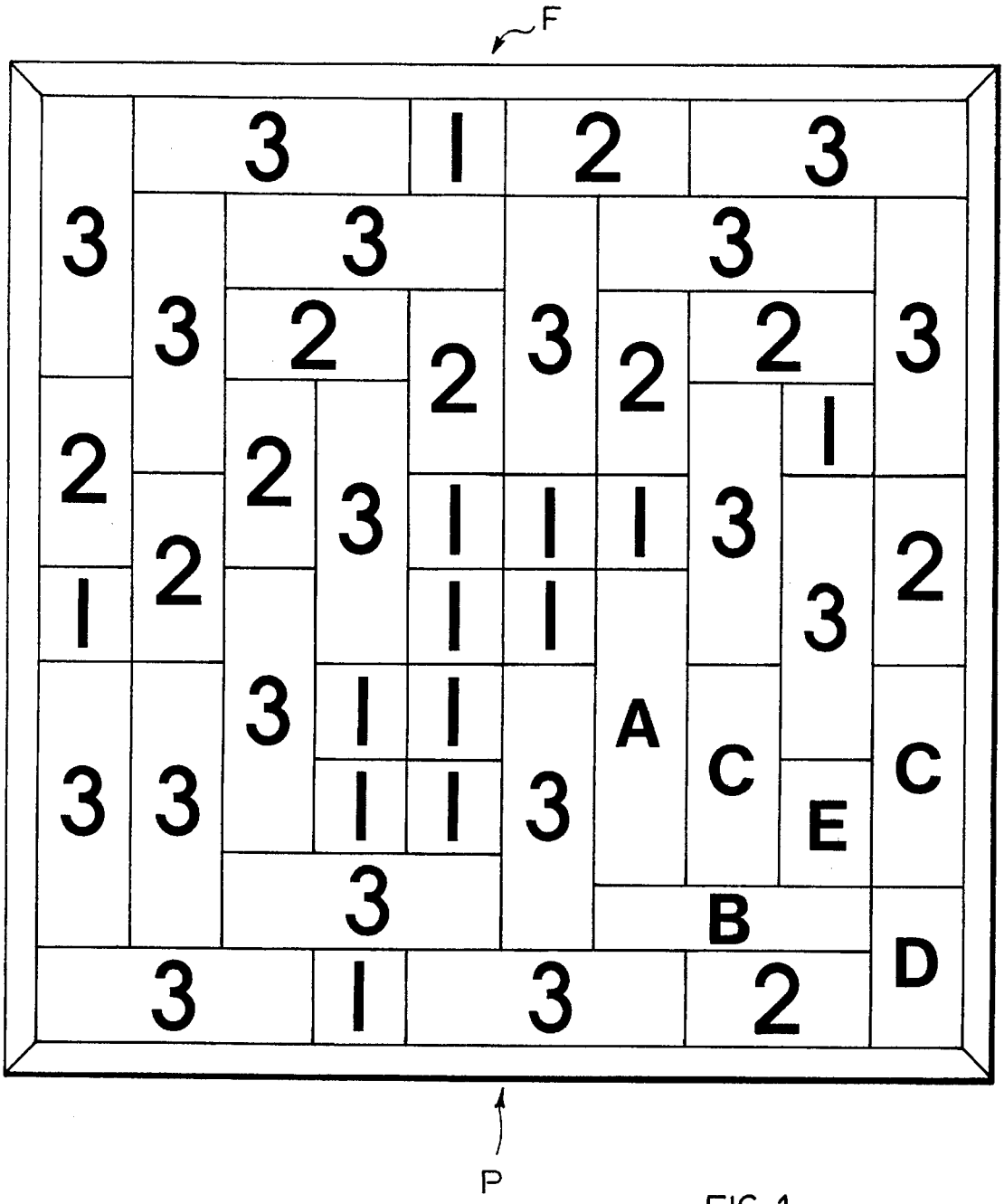
FIG. 1 is a top view of an assembled puzzle according to a preferred embodiment of the present invention.

FIGS. *3a* through *3c* show different embodiments of puzzle pieces which can be used to complete the puzzle of FIG. 1.

DETAILED DESCRIPTION ACCORDING TO THE PREFERRED EMBODIMENTS OF THE PRESENT INVENTION

Figure 2:
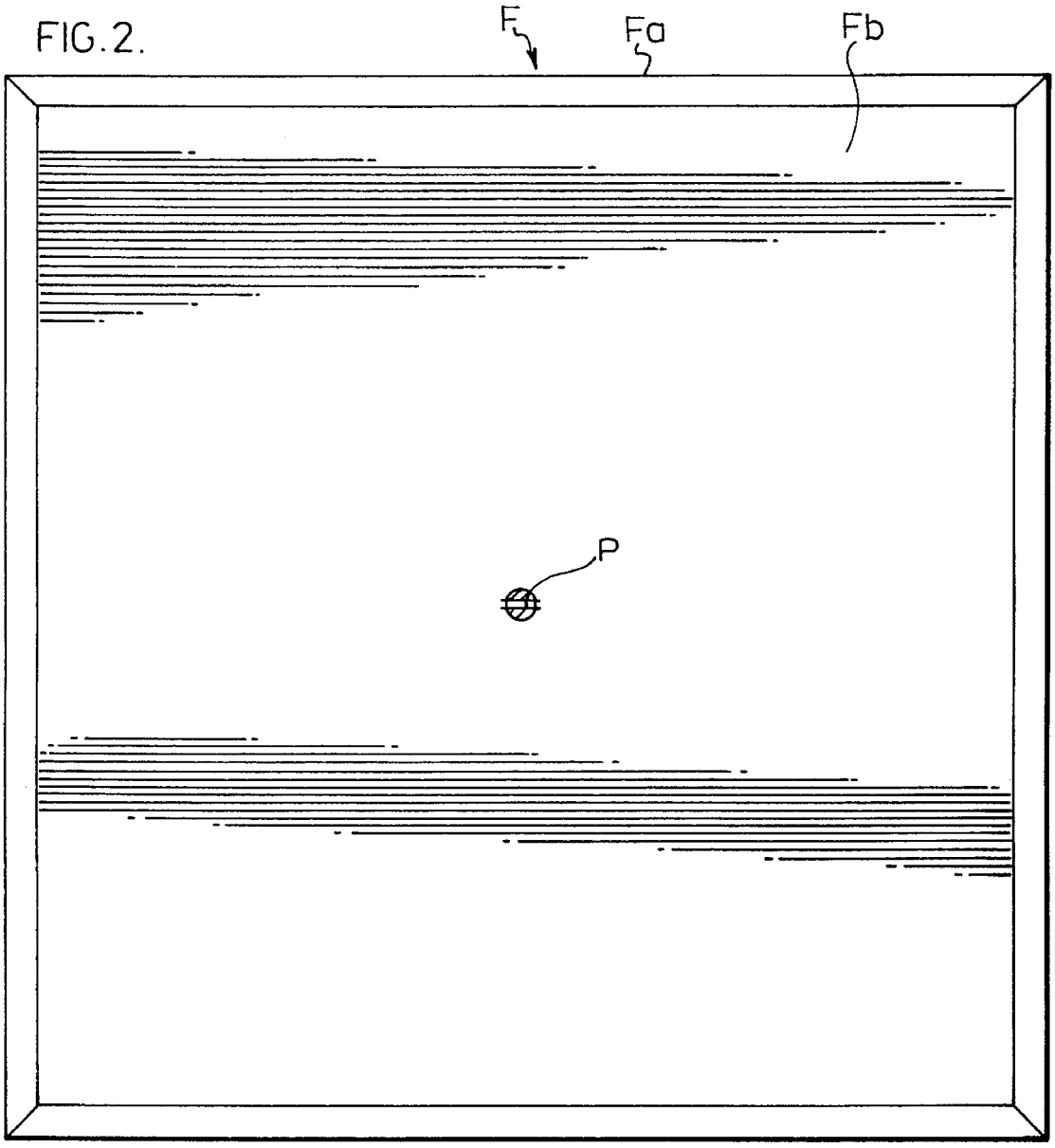
FIG. 2 is a top view of the supporting frame with the puzzle pieces removed from the puzzle of FIG. 1.

FIG. 1 shows a puzzle generally indicated at P. The puzzle comprises a plurality of puzzle pieces which will be described later in detail and which are held within a frame generally indicated at F. FIG. 2 shows that the frame F comprises a support base Fb surrounded by an upstanding frame border Fa. A sliding pin P is provided centrally of the frame base Fb.

The frame with its border provides a base support and surrounding boundary for the puzzle pieces to hold them the rectangular and more specifically square shape shown in FIG. 1 when the puzzle pieces have been properly fitted with one another. The pin P comprises an ejector which ejects one or more of center pieces in the puzzle after it has been completed within the frame making the remainder of the puzzle pieces much easier to pull from the frame.

As shown in FIG. 1, many of the different playing pieces have been given numeral designations. The largest of the playing pieces is indicated at A. There is only one such playing piece. The next largest of the playing pieces are indicated at 3 and as will be seen, there are a number of these playing pieces which are identical in shape and size with one another. Therefore, each piece of the group of playing pieces 2 is interchangeable with any other piece in that particular group within the puzzle.

There are also other groups of playing pieces including the group formed by playing pieces 2 and the group formed by playing pieces 1. All of the playing pieces 2 are of the same shape and size and are therefore interchangeable in positions with one another. The same is true with the group formed by playing pieces 1 which are also the same shape and size as all other pieces in that particular group.

Here it should be noted that pieces 2 and 2 are exactly three times and two times, respectively, the length of piece 1. This makes certain combinations of these pieces interchange with one another as described later in detail.

There are two playing pieces indicated by the letter C and these two playing pieces are of the same shape and size. There is one playing piece indicated by the letter D and one playing piece indicated by the letter E. All of the playing pieces noted above are of the same width. However, all of the playing pieces having different numeral or letter identifications are of different lengths, i.e. piece 3 is of a different length than piece 2 and both of these pieces are of a different length than piece 1. Pieces C, D and E are of different lengths from one another and also different lengths from all other playing pieces.

Finally, there is a playing piece indicated by the letter B and this playing piece, although of the same length as playing pieces 2, is narrower than all other playing pieces in the puzzle.

FIG. 1 shows all of the puzzle pieces going together to form a full square. As will be appreciated from FIG. 1, some of the puzzle pieces can be varied in their position in order to once again achieve a full square. For example, the puzzle pieces 2, 2, C and D appearing along the right side of the puzzle could be varied in their positions as long as this same combination of puzzle pieces is provided, i.e. rather than having the pieces in the order 3, 2, C and D as shown, they could be in the order 3, C, D, 2 and still form the required puzzle shape. However, the puzzle would not be completed for example by having puzzle pieces 2, 2, C and D in replacement of pieces 2, 2, C and D. It could however be completed by using three number 1 pieces in replacement of the number 3 piece as long as the number 3 piece can also be fitted in the location from which the three number 1 pieces have been removed. The same is true with respect to piece 2 which can be replaced by two number 1 pieces as long as the number 2 piece can fit into the location occupied by the two number 1 pieces. Also, a number 1 and 2 piece can be used in replacement of a number 3 piece.

There are obviously other areas in the puzzle where the pieces could be varied in position relative to one another. However, the required combination of pieces at a certain location is required.

One of the key features to the present invention is that because all of the pieces have a rectangular shape whether that be the small square shape of pieces 1 or the longer rectangular shape of pieces 2, one cannot simply look for a unique shape to fit with another unique shape in completing the puzzle. This makes the puzzle more difficult in this regard than conventional puzzles.

Puzzle pieces A, B, E and D being individual or unique in size relative to the other puzzle pieces must fit with a specific combination of other pieces in order to make the puzzle go together. These unique pieces can however fit in a different combination of locations with the required combination of pieces to complete the puzzle.

By way of example again, puzzle piece A must fit with a single piece 3 or a combination of pieces 1 and 2 in a vertical row as shown in FIG. 1. However, any one of pieces A, 1 and 2 can be varied in their positioning relative to one another. In addition, puzzle piece B with its unique width must fit with the combination of pieces A and 3 or A, 1 and 2 to complete the puzzle.

FIG. 1 shows four puzzle pieces 1 directly in the center of the puzzle. FIGS. 3*b* and 3*c* show variations of the puzzle in which the four playing pieces 1 are replaced by two playing pieces 2 in FIG. 3*b*. This is easily achieved because the playing pieces 2, while being of the same width are exactly double the length of playing pieces 1.

The four relatively small square playing pieces 1 centrally of the puzzle can also be replaced by one larger square puzzle piece 4 shown in FIG. 3*c*.

Figure 3A:
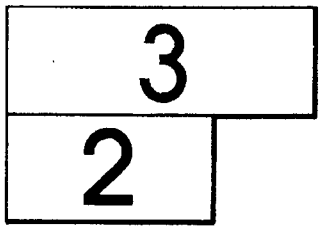
Figure 3B:
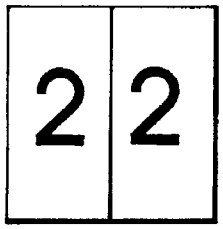
Figure 3C:
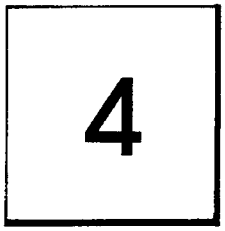

FIG. 3*a* shows that the four central puzzle pieces 1, plus the one additional playing piece 1 located between playing pieces 2 and A can be replaced with playing piece 3 and playing piece 2 positioned relative to one another as shown in FIG. 3*a*. This again occurs because playing piece 3 while being the same width as playing pieces 1 is exactly triple the length of these pieces.

In addition, a combination of playing piece 3 with two playing pieces 1 located beneath playing piece 3 could be used in substitution for the playing piece combination shown in FIG. 3*a*.

In many respects the puzzle of the present invention is for reasons given above more difficult than a conventional puzzle. However, as also described a number of the playing pieces are usable in different positions within the puzzle and therefore the puzzle of the present invention has a different interest factor than conventional puzzles.

FIG. 1 shows the puzzle as having a specific size. It is however to be appreciated that size can be varied by making the playing pieces either bigger or smaller while maintaining their relative proportions.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A puzzle having different groups of playing pieces which form a full rectangle only when properly fitted with one another, all of the playing pieces from all of said groups having a rectangular configuration and each playing piece of a particular group having the same shape and size and being interchangeable in position in said puzzle with all other pieces from that particular group, all of the pieces in said different groups being of the same width with the pieces in one group being of a different length than the pieces of all other groups, said puzzle also including a number of individual rectangular playing pieces which must be fitted with said groups of playing pieces to complete said puzzle and wherein one of said individual pieces is longer than all of the other playing pieces and another of said individual playing pieces is thinner than all of the other playing pieces.

2. A puzzle as claimed in claim 1 including a frame for said playing pieces said frame comprising a base and a border upstanding from said base said border providing a support boundary for said playing pieces, said puzzle including a playing piece ejector comprising a pin slideable vertically in said base of said frame.

3. A puzzle including first, second and third different groups of puzzle pieces which form a full rectangle only when properly fitted with one another, all of the playing pieces from all of said groups having a rectangular configuration and each playing piece of a particular group having the same shape and size and being interchangeable in position in said puzzle with all other pieces from that particular group, all of the pieces in said different group being of the same width with the pieces in said first group being three times the length of the pieces in said third group and the pieces in said second group being twice the length as the pieces in said third group and said puzzle also including a number of individual rectangular playing pieces which must be fitted with such groups of playing pieces to complete said puzzle.

4. A puzzle as claimed in claim 3, wherein one of said individual pieces is the same length as and thinner than the pieces in said first group.

5. A puzzle as claimed in claim 3 including a frame for said playing pieces said frame comprising a base and a border upstanding from said base said border providing a support boundary for said playing pieces, said puzzle including a playing piece ejector comprising a pin slideable vertically in said base of said frame.

* * * * *